US007517170B2

(12) United States Patent
Olmsted

(10) Patent No.: US 7,517,170 B2
(45) Date of Patent: Apr. 14, 2009

(54) METHOD AND APPARATUS FOR MOUNTING A BARRIER OPERATOR

(75) Inventor: Robert J. Olmsted, Wood Dale, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 289 days.

(21) Appl. No.: 11/139,870

(22) Filed: May 27, 2005

(65) Prior Publication Data

US 2006/0267532 A1 Nov. 30, 2006

(51) Int. Cl.
*E01F 13/00* (2006.01)

(52) U.S. Cl. ..... 404/6; 404/9; 256/13.1

(58) Field of Classification Search ..... 404/6–11, 404/83, 72; 256/13.1; 52/64; 249/210; 405/232; 49/49; 248/156
See application file for complete search history.

(56) References Cited

U.S. PATENT DOCUMENTS 1,454,434 A * 5/1923 Gardner ..... 405/243
1,622,528 A * 3/1927 Marqua ..... 249/18
2,913,906 A * 11/1959 Sinclair ..... 74/2
3,606,699 A * 9/1971 Robinson, Jr. ..... 49/280
3,680,430 A * 8/1972 Cannon et al. ..... 411/76
3,775,912 A * 12/1973 Walls ..... 49/131
3,779,025 A * 12/1973 Godley et al. ..... 405/249
3,993,282 A * 11/1976 Berman et al. ..... 249/24
4,212,446 A * 7/1980 Domanick et al. ..... 248/678
4,403,449 A * 9/1983 Richmond ..... 49/340
4,429,264 A * 1/1984 Richmond ..... 318/466
4,613,254 A * 9/1986 Liebig ..... 405/259.3
5,257,489 A * 11/1993 Angelette ..... 52/295
5,351,440 A * 10/1994 Vincent ..... 49/340
5,640,806 A * 6/1997 Hall ..... 49/360
5,830,378 A * 11/1998 Butler ..... 249/18
5,869,940 A * 2/1999 Parsadayan ..... 318/461
5,913,781 A * 6/1999 Vidmar et al. ..... 52/102
5,942,867 A * 8/1999 Richmond ..... 318/280
6,059,258 A * 5/2000 Jackson ..... 249/18
6,091,217 A * 7/2000 Parsadayan ..... 318/285
6,194,851 B1 * 2/2001 Denault et al. ..... 318/139
6,212,825 B1 * 4/2001 Hopkins, Jr. ..... 49/49
6,309,143 B1 * 10/2001 Merjan et al. ..... 405/253
6,468,003 B2 * 10/2002 Merjan et al. ..... 405/253
6,611,992 B1 * 9/2003 Arnaud ..... 16/239
7,037,028 B1 * 5/2006 Donohoe et al. ..... 404/6
7,073,980 B2 * 7/2006 Merjan et al. ..... 405/253
7,115,813 B2 * 10/2006 Young ..... 174/53
2004/0115008 A1 * 6/2004 Merjan et al. ..... 405/253
2005/0086882 A1 * 4/2005 Greenberg et al. ..... 52/299
2005/0217886 A1 * 10/2005 Young ..... 174/53

* cited by examiner

*Primary Examiner*—Raymond W Addie
(74) *Attorney, Agent, or Firm*—Fitch, Even, Tabin & Flannery

(57) ABSTRACT

An apparatus and a method for quick mounting of a barrier operator on a ground surface is disclosed. The apparatus includes a mounting frame positioned on the ground and mounting structure extending into the ground surface. Concrete may then be poured into the mounting frame to form an operator support on which the barrier operator is mounted. The mounting structure may be a mounting post received in an excavated portion of the ground, and the mounting post and excavated portion may then be filled with concrete. The concrete in the frame, mounting post, and mounting frame may communicate as to form a unitary mass with the mounting frame and mounting post. The mounting structure may be mounting rods secured directly with the ground. The mounting rods have a spiral flute for driving into and securing with the ground.

2 Claims, 5 Drawing Sheets

METHOD AND APPARATUS FOR MOUNTING A BARRIER OPERATOR

FIELD OF THE INVENTION

The invention relates to mounting a barrier operator and, in particular, to mounting a barrier operator on a ground surface.

BACKGROUND OF THE INVENTION

Currently, a number of different systems for opening, closing, or otherwise changing the position of a movable barrier are known. Of these, some are mounted on a wall or a ceiling for moving a door or gate. Other systems, or barrier operators, may be mounted on or at a ground surface for moving the barrier.

When mounting a barrier operator on a ground surface, a support structure is provided for securing and supporting the operator. The operator typically has an arm, a chain, or some other device coupling the operator to the barrier, such as a swinging gate. The operator moves the arm, for instance, to apply a force to the large, often metal barrier that spans across a driveway or paved entrance. As every action has an equal and opposite reaction, the force applied by the operator to pull or push the gate will also be experienced by the operator itself. Accordingly, it is important that the structure to which the operator is mounted be soundly installed with the ground, and that the operator itself is soundly installed to the support structure.

The support structure to which the operator is mounted is commonly referred to as a pad and is formed of poured concrete. To install the support structure, a ground area is excavated to a depth, typically at least a foot and often thirty inches or more. This depth will vary based on local soil conditions and other factors such as the frost line depth for the region or locale. In particular, local building codes are consulted for determining the proper minimum depth.

The excavated area is then surrounded by a form rising above the ground level. Concrete is then poured into the excavated area and into the form so that a height of the pad formed is typically at least three inches above the ground level. As the operator is mounted on a top surface of the concrete pad, the pad height provides clearance above the ground so that shifting soil, standing or flowing water, or snow does not as easily enter or cover a bottom portion of the operator. In this manner, the anchoring members, such as bolts, that hold the operator in place on the pad do not continually reside in a moist environment which would otherwise lead to corrosion and, ultimately, failure.

The concrete pad receives the barrier operator on the top surface, typically secured thereto by bolts. The bolts may be pre-set in the poured concrete prior to curing, or bolt holes may be drilled later for receiving the expansion bolts.

In any event, the concrete pad must cure prior to mounting of the operator. Prior to curing, the concrete pad is not capable of supporting the operator. Therefore, if bolts are pre-set, a template must be used to suspend and position the bolts. Alternatively, a template must also be used to drill the bolt or anchor holes for mounting the operator at a later time.

The entire installation process requires an extended period of time and more than one visit to the installation site. At a first instance, the excavation, the building of the form, and the pouring of the concrete may occur on a single day. However, once the concrete has been poured, a period of time must be waited for the curing process. Depending on temperatures and other factors, this curing time can be several days. An installer must return to the site at a later date and perform the steps for installing the operator itself onto the pad.

The provision of the concrete pad, as described, presents additional problems. The entire size of the pad can be, for example, in the order of 36" in height, 24" long, and 28" wide. Such a volume has a significant materials cost and requires an equally significant amount of labor to mix and pour.

Because of the pad size, the concrete is susceptible to failure itself. A block of such as size should be agitated as it is poured to ensure large gas pockets are not formed. Additionally, proper curing may be compromised by soil or weather conditions, and improper curing may result in the pad cracking.

Accordingly, there has been a need for improvements in mounting barrier operators on a ground surface.

SUMMARY

A movable barrier operator mount is disclosed herein for securing and mounting a movable barrier operator with ground. The operator includes a device for coupling the operator with a movable barrier for opening and closing the movable barrier, and the operator includes a motor and a drive system for actuating the coupling device. The operator further includes structure for securing with structure on the operator mount.

The operator mount secures with the ground such that the operator may be secured directly to the operator mount immediately upon installation. In this manner, the issues attendant with allowing setting material such as concrete to cure prior to installation of the operator are relieved. That is, an installer may perform all of the steps necessary for securing the operator with the ground in a single visit.

Toward this end, the operator mount includes a frame positionable flush with a top surface of the ground and having the structure for securing with and supporting the operator located with the frame. The frame defines a volume or form that is filled with the setting material, and the securing structure of the operator mount is positioned above or otherwise clear of the volume. Thus, the securing structure supports the operator above the ground, and a clearance is provided for attaching securements or securing elements to the operator mount and the operator. As such, the state of the setting material (cured or un-cured) bears no impact on the ability of the securing structure to be joined with the operator.

The securing structure of the operator mount is provided by mount plates. The mount plates preferably have pre-located features, such as pre-drilled holes, for securing with the operator. As such, the needs for a template and/or for drilling into an operator pad, as is the case for the prior art, is eliminated.

In one form, the operator mount includes depending structure fixedly secured with the frame. A portion of the ground is excavated for receiving the depending structure. The depending structure includes a cavity, and the excavated ground portion is provided with a clearance around the depending structure. Both the clearance and the cavity are filled with setting material. The setting material in these spaces may communicate with the volume of the frame such that the setting material forms a unitary structure in the cured state. The operator mount may also include mounting structure, such as stakes, with are driven directly into the ground in a linear fashion. The operator mount provides sufficient support and rigidity to permit the operator to be mounted therein, prior to curing of the setting material. Further, the operator may be installed without waiting a time period for the cure, so that an installer may perform all work in a single visit.

The excavated ground portion is significantly reduced in comparison to an excavated ground portion required to form the operator pads of the prior art. Accordingly, the amount of work and time required to excavate the ground portion is also significantly reduced, as are the materials cost of the setting material and the risk of failure of a large block of concrete, for instance.

In another form, the setting material is placed only in the frame. The operator mount is provided with mounting structure received directly into the ground. The mounting structure may be the stakes, noted above, or is preferably rotationally driven members such as mounting rods. The mounting rods may include a spiral-fluted or threaded-screw-like portion such that the mounting rods are self-tapping to obtain purchase directly with the ground or earth. A relatively slow rotation of the mounting rods, with downward pressure, drives the mounting rods and fluting into the ground without churning or plowing the ground.

DESCRIPTION

Figure 1:
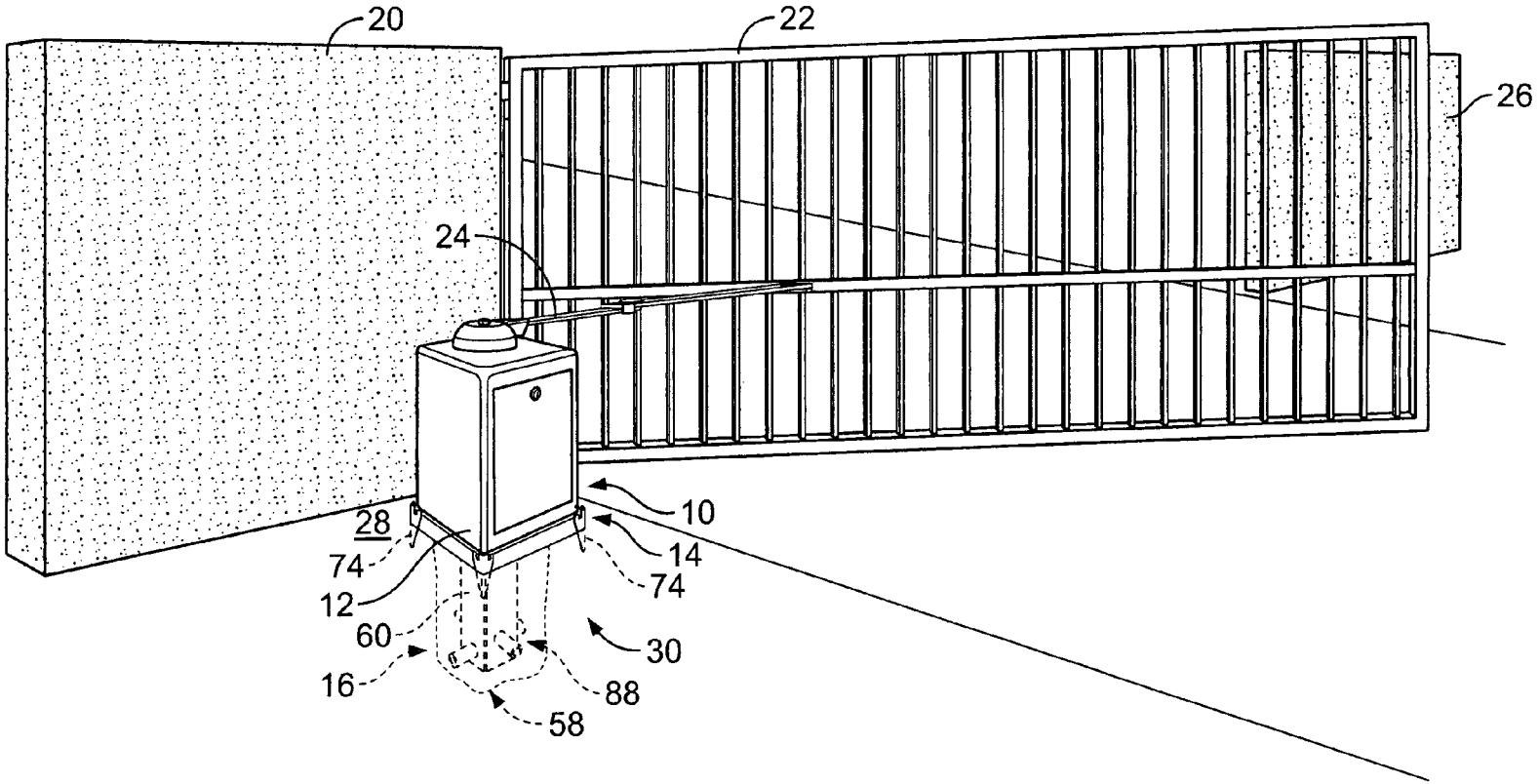
FIG. 1 is an environmental view showing a movable barrier attached to a barrier support and operably secured with a barrier operator for moving the barrier, and showing an operator mount for forming an operator support for fixedly securing the barrier operator at a ground area.

Referring initially to FIG. 1, a barrier operator 10 having a housing 12 is shown secured to an operator mount 14 which is, in turn, secured with an area or volume of ground 16. A support wall 20 is provided for supporting a movable barrier 22 such as a gate. The barrier 22 is depicted as swingably secured to the support wall 20, though the support wall 20 alternatively may be a fence post or the like, or the barrier 22 may be moved in a linear direction. The operator 10 is operably coupled via an operator arm 24 to the barrier 22 for moving the barrier 22 to and between open and closed positions relative to a frame wall 26. Typically, the ground 16 is simply earth, dirt, clay, or other ground materials having a top surface 28 proximate the support wall 20.

The operator mount 14 is used for forming an operator support 30, and the operator mount 14 and support 30 together secure and support the barrier operator 10. As will be described herein, the operator mount 14 is a quick-mount such that the support 30 can be formed and the operator 10 mounted thereon in a minimal amount of time.

Figure 2:
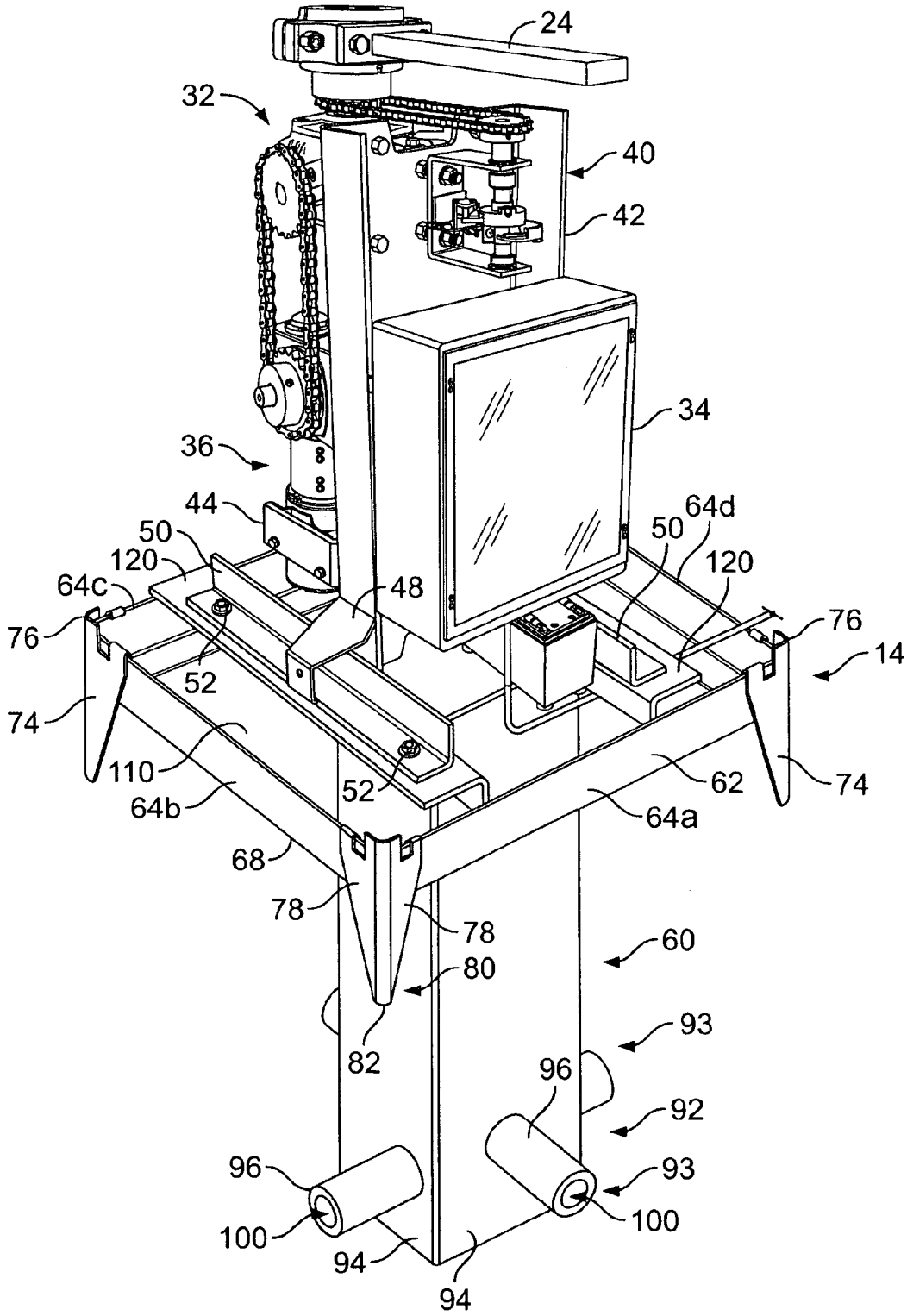
FIG. 2 is a perspective view of the operator mount and the barrier operator with an operator housing removed to show internal components of the barrier operator including an operator frame secured with the operator mount.

With reference to FIG. 2, the operator 10 is shown with the housing 12 removed to expose the operator internal components. The arm 24 is shown connecting to a drive system 32 for directing movement of the arm 24 and, consequently, movement of the barrier 22. A control box 34 is also shown, as is a motor 36 or the like for providing power to the drive system 32 and arm 24. Each of the arm 24, drive system 32, control box 34, and motor 36 are secured to an operator frame 40.

Figure 3:
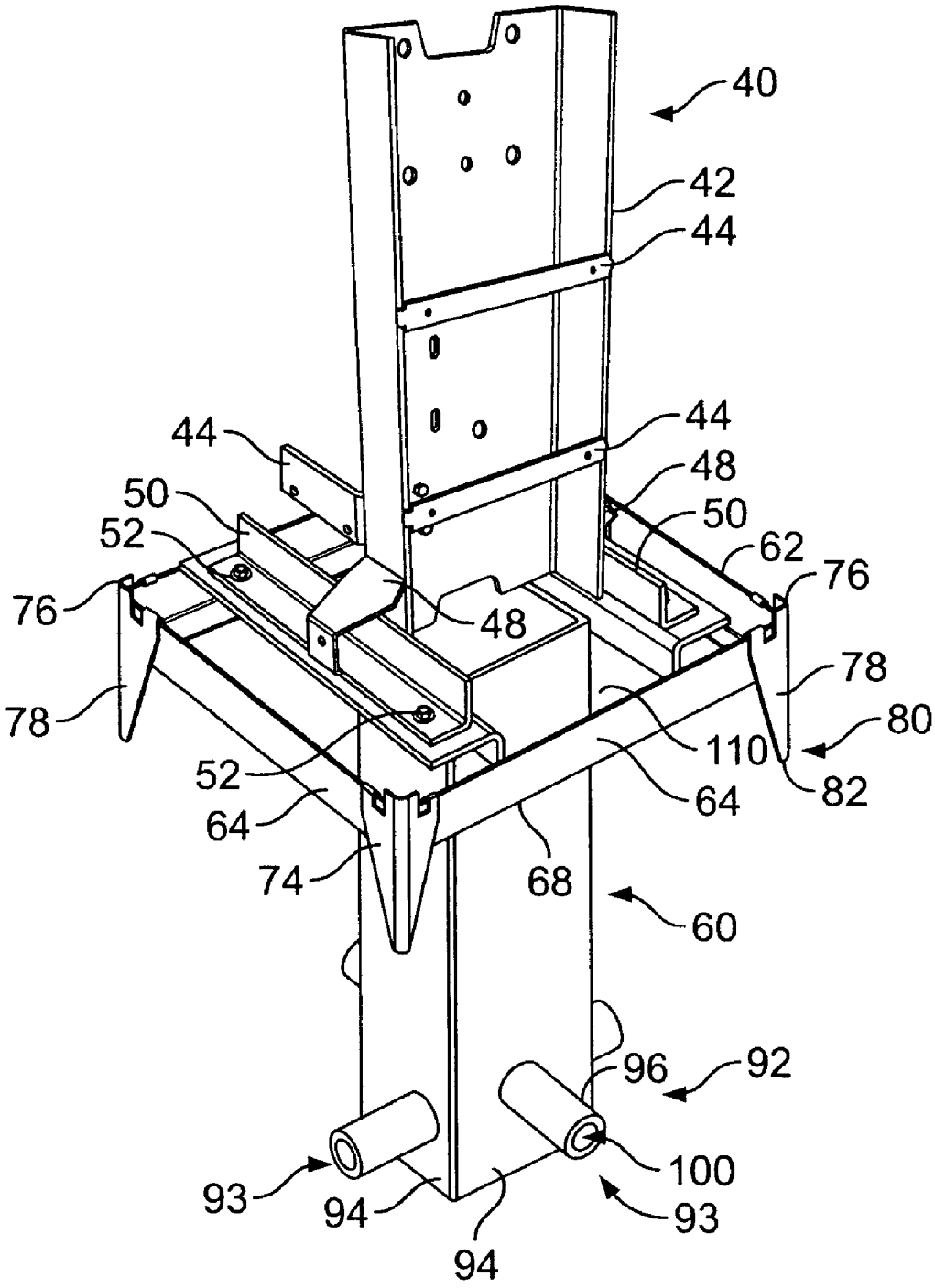
FIG. 3 is a perspective view corresponding to FIG. 2 showing the operator frame secured with the operator mount.

As best viewed in FIG. 3, the operator frame 40 secures with the operator mount 14 and with the internal components of the operator 10, as well as the housing 12. The frame 40 includes an upstanding body 42 with various structures, such as braces 44, for securing the components thereto. The frame 40 also includes side brackets 48 secured to the body 42, and secured with base plates 50. To secure the operator 10 with the operator mount 14, the base plates 50 are secured to the operator mount 14 with securements or fasteners such as with bolts 52, as will be described in greater detail below.

Figure 4:
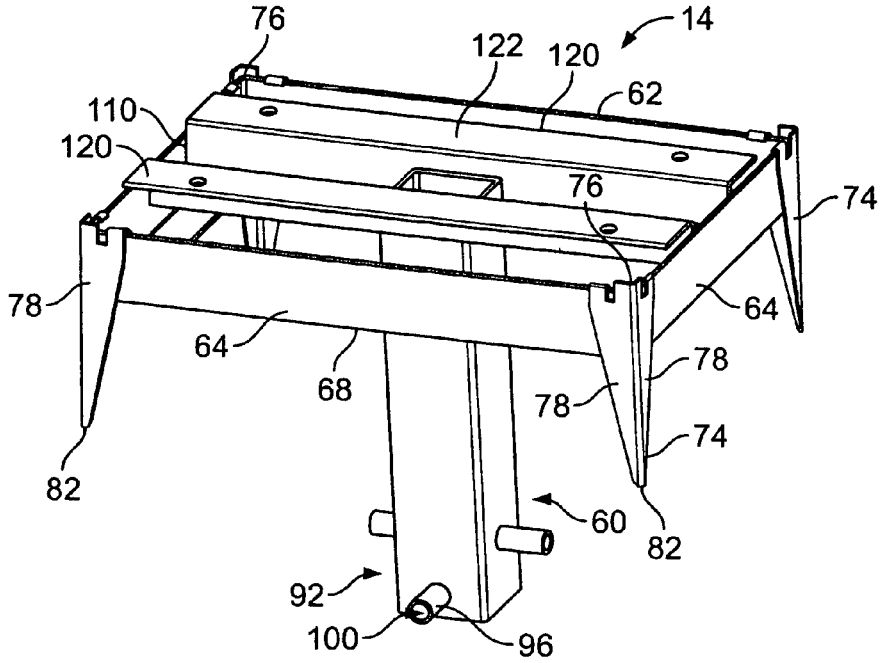
FIG. 4 is a perspective view of the operator mount showing a mount frame, mount brackets, mounting stakes, and a central mounting post for receipt into an excavated ground area.
Figure 5:
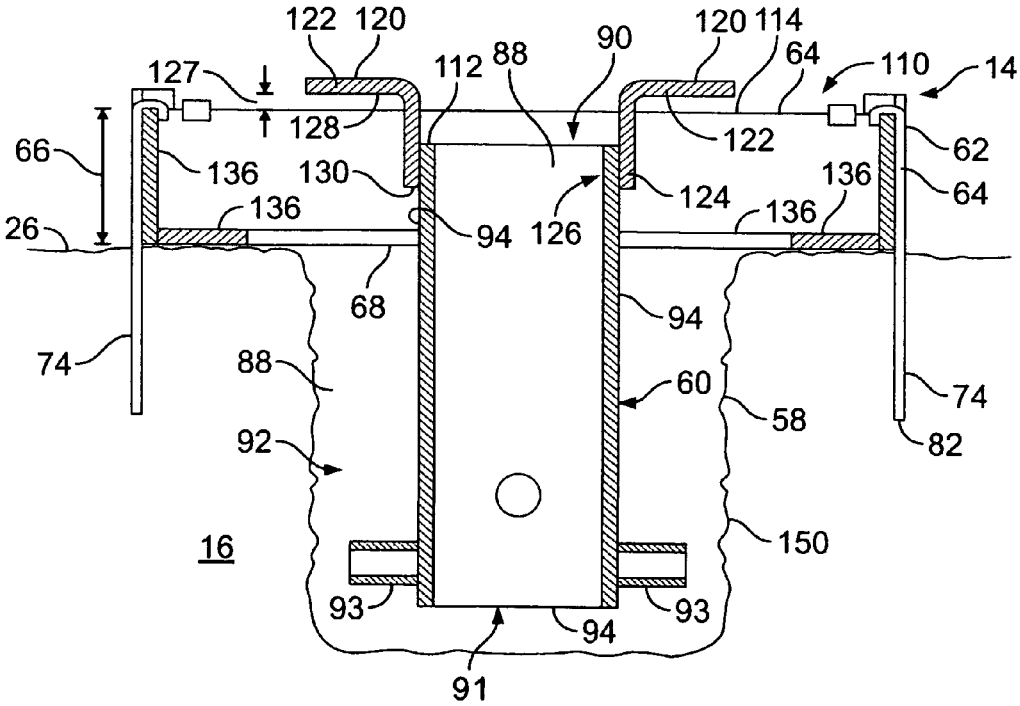
FIG. 5 is a cross-section of an excavated ground area showing the operator mount positioned at and within the excavated ground area for forming the operator support.

Referring now to FIGS. 4 and 5, the operator mount 14 for forming the support 30 is depicted. To install the operator mount 14, the ground 16 is excavated to form a post hole 58, as shown in FIG. 1. The operator mount 14 is then placed over, and mounting structure in the form of a mounting post 60 is positioned within, the post hole 58. The post hole 58 is sized to be larger than the mount post 60, as will be described below. It should be noted that the operator mount 14 may be provided with a plurality of mounting posts 60, though only one is depicted and described herein.

The operator mount 14 is then forced downward such that a mount frame 62 is positioned flush with the top surface 28 of the ground 16. The mount frame 62 is generally rectangular having four sides 64*a*, 64*b*, 64*c*, and 64*d*. Typically, opposed sides 64*a*, 64*c* and 64*b*, 64*d* would be of equal lengths as to form a rectangle the size of the desired support 30. Additionally, the sides 64 have a height 66 (FIG. 5) providing a clearance above the ground surface 28 for the operator 10. By way of example, the frame sides 64 are twenty-four inches long and, and the height 66 is two inches. However, the shape of the frame 62 may be of any desired size, shape, and height. The sides 64 have a bottom edge 68 against which the ground surface 28 abuts when the operator mount 14 is installed with the ground 16.

It should be noted that the operator mount 14 is preferably mounted on the ground to be generally horizontally level. The rotating arm 24, for instance, operates best when moving in a plane oriented in the direction of movement of the barrier 22. Towards this end, it may be beneficial to level the ground top surface 28 prior to installing the operator mount 14. This may be accomplished either by filling an uneven portion of the ground 16, or by an amount of excavation to reduce higher points, or both. In some forms, the operator mount 14 may be sunk a slight amount into the ground 16, and an amount of excavation of the ground 16 may promote such. In any event, the top surface 28 refers to the surface of the ground 16 against which the operator mount 14 is positioned.

The operator mount 14 includes mounting stakes 74 for securing the operator mount 14 with the ground 16. As shown, individual mounting stakes 74 are positioned at and wrap a short amount over each corner 76 of the frame 62 and extend downwardly. Though not shown, a portion of each stake 74 may extend inside a volume 110 defined by the sides 64. Each stake 74 is formed of generally two flat portions 78 aligned with and closely positioned against respective sides 64 of the frame 62. Each flat 78 tapers inwardly towards a distal end 80 of the stake 74 so as to form a point 82. In this manner, the point 82 allows the stakes 74 to be driven into the ground 16 to secure the operator mount 14 flush with the top surface 28.

As stated above, the operator mount 14 is used to form the support 30. With particularly reference to FIG. 5, the operator mount 14 is positioned against the top ground surface 28 with the mounting post 60 located within the post hole 58 formed in the ground 16, and the stakes 74 driven into the ground 16. As will be discussed below, the mounting post 60 is secured with mount brackets 120 which are, in turn, secured with the frame 62. The post hole 58 is generally larger and longer than the mounting post 60 such that an amount of space is initially provided surrounding the mounting post 60 within the post hole 58. In an exemplary form, the mounting post 60 extends twenty-four inches into the post hole 58.

Once the operator mount 14 is positioned flush with the top surface 28, setting material such as concrete 88 is poured to combine with the operator mount 14 to form the support 30. The mounting post 60 is generally a hollow tubular member defining an interior cavity 90. As such, concrete 88 is poured into the cavity 90 and into the post hole 58 around the mounting post 60. The cavity 90 is, for example, six inches square. It is also preferred that the cavity 90 be open at a mounting post bottom 91, as shown in FIG. 5, such that concrete 88 in the post hole 58 may communicate and solidify with the concrete 88 within the cavity 90 through the mounting post bottom 91.

A lower end of the mounting post 92 includes a number of fixtures 93 for improving the securement between the mounting post 60 and the post hole 58. It is preferred that the lower end of mounting post 92 is generally square having four sides 94. Each side 94 of the lower end of the mounting post 92 includes a cylindrical spur 96 extending orthogonally from its respective side 94. The spur 96 is hollow to define a cavity or passage 100 in communication with the interior cavity 90 of the mounting post 60 and with the post hole 58. As the concrete 88 is filled into the post hole 58 and mounting post cavity 90, the concrete 88 will also flow into and, preferably, through the spur 96 such that the concrete 88 within and without the mounting post 60 cures as a unitary structure. In the present form, the spurs 96 are six inches long, and the passage 100 has a diameter of one inch.

To form a solid support for the operator 10, the concrete 88 within the mounting post 60 and post hole 58 is secured with the mount frame 62 and with the top ground surface 28. As can be seen in FIG. 4, the frame sides 64 bound the volume 110 so that the mounting frame 62 serves as form for concrete 88 poured therein. The mounting post 60 has an upper edge 112 positioned below a top edge 114 of the frame sides 64 such that the mounting post cavity 90 is in communication with the volume 110. Additionally, the post hole 58 is in communication with the volume 110. (See FIG. 5). Advantageously, concrete 88 poured into the volume 110 is then able to cure and solidify with concrete 88 located within the mounting post cavity 90, and with the concrete 88 located within the post hole 58. As noted above, the concrete 88 within the mounting post 60 cures and solidifies with the concrete 88 in the post hole 58 through the spurs 96. In this manner, the mounting post 60 and operator mount 14, in general, are soundly secured with the concrete 88 and the post hole 58. Due to this securement, as well as the mass of the concrete 88 and the stakes 74 driven into the ground 16, the operator mount 14 forms the support 30 for the operator 10. Moreover, this combination provides a solid support 30 for sound connection and securement with the operator 10 prior to setting or curing of the concrete.

As noted above, the operator frame 40 secures with the operator mount 14. The base plates 50 of the operator frame 40 are secured with mount brackets 120 fixed to the operator mount 14. More specifically, the mount brackets 120 have a generally horizontal mount plate 122 and a generally vertical fixing plate 124 so that the mount brackets 120 form an L-shape. The fixing plates 124 are fixedly secured, such as by welding, with an upper portion 126 of the mounting post sides 94, and may also be secured with the frame sides 64. The mount brackets 120 are positioned such that the mount plates 122 are positioned above the top edges 114 of the frame sides 64. This allows a short clearance 127 between a bottom side 128 of the mount plates 122 and the volume 110 of the mount frame 62 filled with concrete 88. The clearance 127 allows connectors, such as the bolts 52, to be secured on the mount plate bottom sides 128. The mount plates 122 secure with the base plates 50, such as with the bolts 52.

The described construction of the mount frame 62 and mount brackets 120 inhibit the ability of flowing or standing water, snow, or debris to come into contact with the securements such as the bolts 52. The frame 62 and mount brackets 120 provide the described clearance such that the securements are positioned a distance above any water, for instance. Additionally, the frame 62 acts as a barrier for material such as water, precipitation, soil, or debris to pass under the securements.

It should be noted that the mount brackets 120 do not interfere with the communication of concrete 88 between the mounting post cavity 90 and the volume 110. As best seen in FIG. 5, the fixing plates 124 have a bottom edge 130 which is positioned above the ground surface 28 and above the bottom edge 68 of the sides 64. Accordingly, the concrete 88 is free to flow or be forced around and below the fixing plates 124.

In a preferred form, the mount frame 62 is provided with additional structure for rigidity and for enclosing the concrete 88 within the volume 110. As can be seen in FIG. 5, the mount frame sides 64 are provided with crosspieces 136 along the bottom edges 68. The crosspieces 136 resist deformation of the mount frame 62 due to shear stress, provide a more rigid structure, and are positioned below a portion of the concrete 88 located in the volume 110.

Preferably, the crosspieces 136 are formed integral with the sides 64 to form an L-shape. By way of example, the mount frame 62 may be formed of a single elongated piece of steel with three 90 degree notches forming a right triangle cut into one edge at the position of three of the corners. The piece of steel may then be folded along a longitudinal line intersecting each apex of the three triangles so that the steel piece forms the L-shape. The piece of steel may then be folded along a lateral line bisecting each triangle so that a rectangle is formed from the steel piece, and the longitudinal ends of the steel abut and may be joined such as by welding. The edges of the triangles also abut in this configuration, and may be welded if desired.

It is preferred that the height of the operator mount 30 not decrease over time. Were the operator support 30 to settle, a number of problems may occur, such as mis-alignment of the arm 24 and barrier 22 at their, or increased susceptibility of the securements such as bolts 52 to moisture. The above-described prior art operator pads have a significant weight due to the volume of concrete which can depress the supporting ground or earth below the pads. The present operator support 30 formed by the operator mount 14 provides sufficient support and rigidity required for the operator 10 while having a much lower weight than the prior art operator pads. Therefore, settling by the operator support 30 is less likely than for the prior art pads. Additionally, the construction of the frame 62 such that the frame 62 filled with concrete 88 is positioned above and against the ground surface 28 provides an area of support by the ground roughly equal to that of the prior art pads. Consequently, the weight or force per area on the ground by the operator support 30 is reduced, in comparison to the prior art pads, without a sacrifice of the support and securing provided to the operator 10 itself.

As is readily apparent, other constructions for the mount frame 62 are available. For instance, the mount frame 62 may be biodegradable, and the stakes 74 wrapping over the corners 76 of the mount frame 62 may extend in a greater distance so that they cooperate with the volume 110. In this example, the mount frame 62 may serve as a form for the concrete 88 poured into the volume 110 and may, at some later time, degrade so that the stakes 74, mounting post 60, and mount brackets 120 fixed to the operator 10 remain secured with or embedded in the concrete 88.

As can be seen in FIG. 5, a boundary 150 of the post hole 58 is well within the extent of the frame sides 64. Accordingly, much less work and time are required to excavate the post hole 58 in comparison to the prior art support pad, discussed above. In addition, the amount of concrete 88 used is significantly reduced with the operator mount 14. As the entire mass of concrete 88 is much smaller than the prior art support pads, there is less work in pouring and reaming the concrete, and less risk of improper curing.

Due to the construction of the support 30 using the operator mount 14, the operator 10 may be installed immediately without needing the concrete 88 to be cured. The position of the operator mount 14 with the ground 16, and being secured there by the stakes 74, provides sufficient support for the operator 10 to be immediately secured thereon. Furthermore, the support 30 formed by the operator mount 14 and concrete 88 provide sufficient support and securement to the operator 10 that operation of the operator 10 to move the barrier 22, as described above, may immediately be full service, though this may depend on environmental factors such as soil conditions. Alternatively, the operator 10 may be secured to the support 30 by connecting the operator frame 40 to the mount plates 122 of the operator mount 14, while leaving the arm 24, for instance, disconnected from the barrier 22. In this manner, a user may simply and easily connect the arm 24 to the barrier 22 after a reasonable amount of time (for curing of the concrete 88) without the need for a return trip by an installer.

Figure 6:
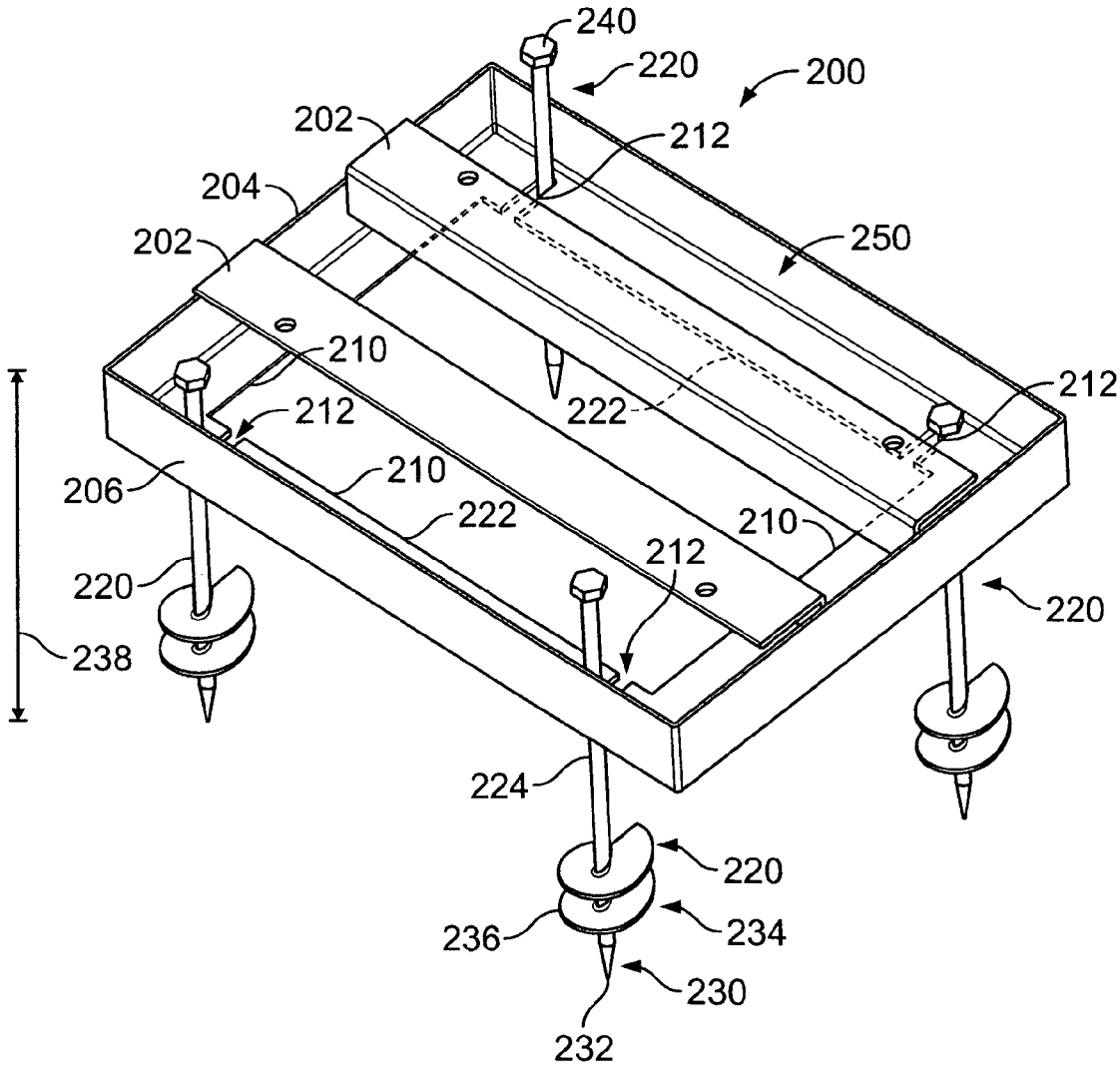
FIG. 6 is a perspective view of an alternative embodiment of an operator mount showing a mount frame, mount brackets, and a plurality of mounting rods for receipt into the ground area.

Referring now to FIG. 6, an alternative embodiment for a quick-mounting operator mount 200 for forming an operator support 30 is depicted having alternative structure for securing the operator mount 200 with the ground 16. As can be seen, the mounting post 60 of the previous embodiment has been omitted, though it may be included.

The operator mount 200 includes mounting structure in the form of mounting rods 220 for securing with the ground 16, either in place of or in addition to the mounting post 60 and stakes 74. As can be seen, the operator mount 200 is provided with mount brackets 202 for securing with the operator frame 40, the mount brackets 202 being similar or identical to the above-described mount brackets 120. The mount operator 200 further includes a mount frame 204 having sides 206 generally constructed as described above for sides 64, and crosspieces 210 which may be constructed in the manner of the crosspieces 136. The mount brackets 202 secure to the sides 206.

The crosspieces 210 differ from the above-described crosspieces 136 so that the crosspieces 210 allow the mounting rods 220 to secure the mount frame 204 with the ground 16. The crosspieces 210 include bores or slots 212 extending therethrough, and the mounting rods 220 are received into and through the slots 212. The slots 212 are open on an inner side 222 of the crosspieces to allow the mounting rods 220 to be received therein.

The mounting rods 220 are designed to seat securely in the ground 16. Each mounting rod 220 has a body 224 having a lower terminal end 230 with a sharp tip 232 for driving into the ground 16 without a need for excavation or a pilot hole. Positioned a short distance above the tip 232 is a screw-like element 234 that is relatively large in comparison to the mounting rod body 224 with relatively thin spiral fluting 236 for being rotationally driven into the ground 16. Under slow rotation, the element 234 will self-tap into the ground 16 while the thin fluting avoids significant plowing or churning of the ground 16 so that the ground 16 retains a significant amount of its packed density and integrity. The mounting rods 220 are provided with a length 238 such that the fluting 236 reaches a depth sufficient for securing the mount frame 204 with the ground 16. Preferably, the fluting 236 makes at least one full turn around the mounting rod body 224. Each mounting rod 220 further has an enlarged head 240 of sufficient size so that the head 240 does not pass through the slots 212. The head 240 is preferably formed as to mate with a wrench, pliers or the like, though it may be provided with a recess for a driver such as a flat-head driver, Phillips head driver, or hexagonal key driver.

The operator mount 200 is simple to install to form the operator support 30. The mounting rods 220 are positioned within the slots 212 with the head 240 above the crosspieces 210. The mount frame 204 is then positioned generally in a desired location for the operator 10 to be located. Each mounting rod 220 is then driven into the ground 16 until the mount frame 204 is flush with the top ground surface 28 and the mounting rod head 240 is tightly positioned against its crosspiece 210 around the slot 212. As will be appreciated, a washer (not shown) of various types may be provided between the head 240 and the crosspiece 210 to enhance the securement therebetween. As the mounting rods 220 are not typically susceptible to heave due to frost conditions, the need for the mounting post 60 and for concrete being poured into an excavated post hole 58, as in the previous embodiment, may be eliminated.

Once the operator mount 200 is secured with the ground 16, the operator support 30 may be formed. As with the previous embodiment operator mount 14, the frame 204 defines a volume 250 which is then filled with concrete. The mounting rods 220 may include additional structure (not shown) extending above the head 240 so that the rods 220 extend into the volume 250 and into the concrete received by the volume 250. In the event the frame 204 is biodegradable, such additional structure on the mounting rod 220 would allow it to remain secure with the concrete in the volume 250 once the frame 204 no longer remains or maintains its structural integrity.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A method of installing a movable barrier operator, the method including:

providing an operator mount which includes a cavity and a mounting bracket;

disposing a portion of the operator mount within the ground;

securing a portion of the operator mount generally flush against a top surface of the ground;

disposing a curable settable material into the cavity and leaving the mounting bracket above the settable material, the mounting bracket configured to couple with the movable barrier operator;

securing the movable barrier operator with the mounting bracket of the operator mount above the curable settable material;

curing the settable material before or after securing the movable barrier operator is secured to the mount bracket;

wherein the operator mount includes a mounting structure and the disposing the operator mount within the ground includes driving at least a portion of the mounting structure into the ground;

wherein the mounting structure includes an elongated hollow member which is open at a top end to receive the curable settable material, the elongated hollow member open at a bottom end is configured to have the curable settable material flow therefrom.

2. A method of installing a movable barrier operator, the method including:

providing an operator mount which includes a cavity, a mounting structure and a mounting bracket, the mounting structure including stakes configured to pierce the ground and at least one mounting post configured downwardly to be position in a hole in the ground, the mounting post an elongated hollow member which is open at a top and a bottom end configured to receive a curable settable material;

disposing the stakes and the mounting post within the ground;

securing a portion of the operator mount generally flush against a top surface of the ground;

disposing the curable settable material into the cavity and the mounting post and leaving the mounting bracket above the settable material, the mounting bracket configured to couple with the movable barrier operator;

securing the movable barrier operator with the mounting bracket of the operator mount above the curable settable material; and curing the settable material before or after securing the movable barrier operator is secured to the mount bracket.

* * * * *